United States Patent [19]

Bourne et al.

[11] 4,165,983

[45] Aug. 28, 1979

[54] JEWELRY ALLOYS

[75] Inventors: Alan A. Bourne, Wargrave; Arthur G. Knapton, Henley on Thames, both of England

[73] Assignee: Johnson, Matthey & Co., Limited, London, England

[21] Appl. No.: 880,880

[22] Filed: Feb. 23, 1978

[30] Foreign Application Priority Data

Feb. 23, 1977 [GB] United Kingdom ..... 7601/77
May 26, 1977 [GB] United Kingdom ..... 22331/77

[51] Int. Cl.[2] ..... C22C 5/04; C22C 5/00
[52] U.S. Cl. ..... 75/172 R; 75/172 G
[58] Field of Search ..... 75/172 R, 172 G, 134 T

[56] References Cited

U.S. PATENT DOCUMENTS 3,357,825 12/1967 Douglass ..... 75/172
3,819,366 6/1974 Katz ..... 75/172 R
3,989,515 11/1976 Reiff ..... 75/172 R
4,012,228 3/1977 Dudek et al. ..... 75/134 C

OTHER PUBLICATIONS

Guex et al., "Binary Systems Pt-Al, Pt-Ga & Pt-In" J. Less-Comm. Metal, 46 (1976) 101.

*Primary Examiner*—L. Dewayne Rutledge
*Assistant Examiner*—Upendra Roy
*Attorney, Agent, or Firm*—Cushman, Darby & Cushman

[57] ABSTRACT

An alloy suitable for use in the fabrication of jewelry containing at least 95% by weight platinum and 1.5 to 3.5% by weight gallium, the balance being at least one of indium, gold, palladium, silver, copper, cobalt, nickel, ruthenium, iridium and rhodium. A Ga/Au/Pt alloy is preferred for ornamental application, and a Ga/In/Pt possibly including gold, silver or palladium is preferred for use in the manufacture of springs and clasps. Alloys are described which comply with hall-marking requirements but yet casting may be effected more easily than with pure platinum.

9 Claims, No Drawings

JEWELRY ALLOYS

This invention relates jewelery; alloys which may be used for the fabrication of jewellery; more particularly it relates to jewelery alloys containing a platinum metal. Although certain of the alloys of this invention are ductile and may be fabricated by the usual metallurgical techniques into sheet, wire etc., it is an object of the invention to provide platinum alloys which may be cast more readily than known platinum alloys. In recent years platinum has come into increasing prominence as a metal used for jewellery fabrication. The pure metal, however, has a relatively high melting point (1769° C.) and is difficult to cast by, for example, the lost-wax investment casting processes frequently employed by the jeweller. As a result of the high melting point, heating of the alloy or metal to achieve sufficient fluidity presents problems, for example, the molten metal or alloy sometimes severely attacks crucible and mould materials and, moreover, the quantity of metal that may be cast in a single operation is limited. In addition the Hallmarking authorities stipulate that hallmarked platinum jewellery must contain a minimum of 95% by weight of the metal. It is an object of the present invention to provide an alloy which may be used in the fabrication of platinum jewellery in that it complies with hallmarking requirements but nevertheless casting may be carried out more easily than with pure platinum as a consequence of the melting point being substantially below that of pure platinum.

According to the present invention an alloy suitable for use in the fabrication of jewellery contains, apart from impurities, at least 95% by weight platinum, and 1.5 to 3.5% by weight gallium, the balance, being at least one of the metals indium, gold, palladium, silver, copper, colbalt, nickel, ruthenium, iridium and rhodium. It has been found that gallium is particularly advantageous in this respect.

Preferably the gallium content ranges from 2 to 3% by weight and the balance is preferably made up by gold ranging from 2 to 3% by weight. If desired a deoxidiser such as yttrium may be added to reduce the casting temperature. Preferably, yttrium is present in an amount of 0.1% by weight.

A higher gold content is preferred in metal for ornamental use and a lower gold content may be used to produce a springy alloy suitable for use, for example, in clasps.

The alloy 3%Ga-2%Au-95%Pt has a Vickers Pyramid Number hardness of 200 but in many platinum jewellery applications much harder metals are needed for use in the manufacture of, for example, springs and clasps.

One preferred embodiment of alloy suitable for this purpose contains from 0.5 to 3.5% by weight indium, the balance, if any, (excluding impurities) being one or more of the said metals excluding indium.

We prefer to use from 2.5 to 3.0% by weight gallium and from 1.0 to 1.5% by weight indium. Any balance is preferably made up by gold, silver or palladium.

The invention will now be described in greater detail with reference to examples of alloys in accordance therewith.

A series of ternary alloys containing 2–4% Ga were cast to establish their melting ranges, and to determine the effect of the addition to the hardness values of the basic platinum/gallium alloy. (Table 1).

TABLE I

| Composition % by Weight | | | | | Hardness HV | | | |
|---|---|---|---|---|---|---|---|---|
| Ga | In | Pt | | | As Cast | Cold Worked and Annealed | Solidus ° C. | Liquidus ° C. |
| 4 | | 95 | Ag 1 | Comparative | 290 | | 1490 | 1600 |
| 4 | | 95 | Ag 1 | Comparative | 360 | | 1500 | 1600 |
| 3.5 | | 96.5 | | Comparative | 292 | 182 | | |
| 3.5 | | 95 | Au 1.5 | | 339 | | | |
| 3.0 | | 95 | Au 2.0 | | 183 | | 1560 | 1600 |
| 3.0 | | 95 | Cu 2.0 | | 180 | 165 | | |
| 3.0 | | 95 | Ru 2.0 | | 164 | | | |
| 3.0 | | 95 | Ir 2.0 | | 154 | | | |
| 3.0 | | 95 | Ru 2.0 | | 154 | | | |
| 3.0 | | 95 | Co 2.0 | | 230 | 195 | | |
| 3.0 | | 95 | Ru 1.0 | Au 1.0 | 170 | | | |
| 3.0 | | 95 | Rh 1.0 | Au 1.0 | 187 | | | |
| 3.0 | 1.0 | 96 | | | 240 | 206 | | |
| 3.0 | 1.5 | 95.5 | | | 240 | 220 | | |
| 3.0 | 1.0 | 95.0 | Au 1.0 | | 245 | 223 | | |
| 3.0 | 0.5 | 95 | 1.5 Au | | 167 | | | |
| 2.5 | | 95 | Ag 2.5 | | 145 | | 1525 | 1590 |
| 2.5 | | 95 | Pd 2.5 | | 154 | | 1580 | 1600 |
| 2.5 | | 95 | Au 2.5 | | 171 | | 1560 | 1620 |
| 2.5 | 2.5 | 95 | | | 285 | | 1560 | 1600 |
| 2.0 | | 95 | Au 3.0 | | 134 | | 1580 | |
| 2.0 | | 95 | Ag 3.0 | | 130 | | 1560 | |

Other alloys which are particularly useful but for which comparative data is not available, contain 95% by weight Pt, 3% by weight Ge and 2% by weight Ag as Pd. Another alloy may include 2% Ga and 3% Pd.

Small scale centrifugal casting experiments were completed on some of the softer alloys with hardness values less than 180Hv. The investment used in these trials was Kerrs Platinite which is used for casting platinum alloys by the last wax process. As the melting points of these alloys are high the melting was carried out using an oxy-hydrogen torch.

Dress ring castings were produced for these trials as this type of casting with its fine claw setting gives a good indication of the fluidity of the alloys.

The results of these trials showed that the silver bearing alloys, in particular the 2.5%/Ag/2.5%Ga-Pt, showed good casting qualities. However the high vapour pressure of silver caused a considerable loss during melting.

The tests also showed that although the gold bearing alloys have a higher melting range, their casting qualities appear to be good. Attempts were made to combine the advantages of both gold and silver while minimising the vapourisation of silver by casting two further alloys, 1wt%/Au/1wt%Ag/3wt% Ga/Pt (181–193Hv as cast).

Although the loss of silver during melting was reduced, it was not entirely eliminated and the melting range was not improved. The alloy containing 3wt%Ga was also unsuitable due to its high hardness.

Casting trials were then carried out on a larger scale where trees containing up to seven dress rings were produced. The initial trials were carried out on three alloys, 3wt%Ga/Pt (for comparison only); 2.5wt%Ga 2.5wt%Au/Pt; 2wt%Ga/3wt%Au/Pt.

These casting trials completed in air revealed that the 2%Ga/3%Au/Pt which had the highest melting range required less superheat than the other alloys with higher gallium contents to completely fill the investment trees.

| Alloy | Casting Temperature | Result |
|---|---|---|
| 3%Ga-Pt | 1960° C. | 2 out of 6 rings complete |
| 2.5%Ag 2.5%Au-Pt | 1990° C. | All complete |
| 2%Ga 3%Au-Pt | 1960° C. | All complete |

The effects of casting under reducing atmospheres were examined, but the results obtained from these tests were rather erratic. The radiation pyrameters used for controlling the casting temperatures gave unreliable readings when a protective atmosphere was used. Measuring the temperature of the melts with a Feussner thermocouple was also attempted but the lack of a suitable refractory sheath capable of withstanding the temperature prevented accurate results.

However, gas analysis on these alloys cast under various atmospheres did show differences in oxygen content (see Table 2).

These results show that the increased fluidity of the alloys containing gold compared with the binary gallium-platinum is due to its ability to prevent the formation of gallium oxide.

Deoxidation of a 2%Ga/3%Au/Pt prior to casting at 1900° C. was carried out by the addition of calcium boride to the surfaces of the melt. The resultant tree gave 4 out of 7 completely filled rings which was a marked improvement on the casting without any protective gas cover although examination of the rings showed that the boride has promoted some metal mould reaction.

TABLE 2

| Alloy | Atmosphere during casting | $O_2$ content | Density g/cm$^3$ | Hv | UTS T.S.I. | % EL. | 0.1% proof stress T.S.I. |
|---|---|---|---|---|---|---|---|
| 3% Ga-Pt | Air | 70 ppm | 19.8 | 153 | 17.0 | 32 | 9.0 |
| 3% Ga-Pt | 10% $H_2/N_2$ | 12 ppm | | | | | |
| 2.5%Ga 2.5%Au-Pt | Air | 26 ppm | 20.0 | 171 | 18.5 | 20 | 11.8 |
| 2.5%Ga 2.5%Au-Pt | 10% $H_2/N_2$ | 14 ppm | | | | | |
| 2%Ga 3%Au-Pt | Air | 18 ppm | 20.3 | 134 | 22.5 | 19.6 | 10.5 |
| 2%Ga 3%Au-Pt | 10% $H_2/N_2$ | 8 ppm | | | | | |

The 2% by weight Ga, 3% by weight Au, alloy offers a lower investment casting temperature than known alloys, the casting temperature in air of fine-sectioned components being 80–90° C. lower than few known alloys. This can be improved by the addition of a deoxidiser for example 0.1% yttrium, which reduces this required temperature by a further 30° C. The addition of yttrium reduces oxide formation without promoting investment reaction. Results have also shown that melting under a reducing atmosphere enables the alloy to be cast at an even lower temperature, estimated to be approximately 1900° C.

The casting scrap can be re-cast providing 25% virgin material containing the deoxidiser is added to each charge.

Examination of the grain size of rings cast in the 2%Ga 3%Au-Pt alloys shows no significant porosity. This alloy is considered amenable to all normal jewellery fabrication processes normally applied to castings.

A number of the trial alloys referred to above were examined to determine their suitability for clasp applications. The results showed that a number of these alloys gave suitable hardness values in the as cast condition, although fabrication of some of these alloys into sheet reduced the annealed hardness to below the required value.

The greatest reduction in hardness was noted with the 3.5wt%Ga-Pt alloy where a decrease of approximately 110 was measured. However hardness values of the other alloys decreased by a much less significant amount. Examination of the cast structure of the 3.5wt%Ga-Pt alloy showed that the high cast hardness could be attributed to a heavily cored structure containing a fine dispersion of second phase, the intermetallic compound $Pt_3Ga$. Subsequent heat treatments and hot forging produced a fully homogenised single phase alloy with the lower hardness value.

A comparison of the mechanical properties of these alloys with the existing clasp alloys revealed that the 1.5wt%In 3wt%Ga-Pt and 1wt%In Lwt%Au 3wt%Ga-Pt alloys in particular, would be acceptable substitutes for spring/clasp applications.

What we claim is:

1. An alloy suitable for use in the fabrication of jewelery consisting essentially of, apart from impurities, at least 95% by weight platinum, and 1.5 to 3.5% by weight gallium, the balance being at least one of the metals indium, gold, palladium, silver, copper, cobalt, nickel, ruthenium, iridium and rhodium.

2. An alloy according to claim 1 wherein the gallium content ranges from 2 to 3% by weight.

3. An alloy according to claim 2 wherein the balance is made up by gold in an amount of from 2 to 3% by weight.

4. An alloy according to claim 3 containing 2% by weight gallium, 3% by weight gold and 95% by weight platinum.

5. An alloy according to claim 1 containing 1.5 to 3.5% by weight gallium, 0.5 to 3.5% by weight indium and the balance, if any, being made up of one or more of the said metals excluding indium.

6. An alloy according to claim 5 wherein the gallium content ranges from 2.5 to 3.0% by weight and the indium content ranges from 1.0 to 1.5% by weight.

7. An alloy according to claim 6 wherein the balance is made up by gold, silver or palladium.

8. An alloy according to claim 1 modified in that it contains a deoxidising agent.

9. An alloy according to claim 8 wherein the deoxidising agent is yttrium and is present in any amount of 0.1% by weight.

* * * * *